United States Patent [19]

Hseu

[11] Patent Number: 4,559,929

[45] Date of Patent: Dec. 24, 1985

[54] MASSAGE DEVICE

[75] Inventor: Victor C. Hseu, St. Louis, Mo.

[73] Assignee: Hyman Products Co., Inc., Maryland Heights, Mo.

[21] Appl. No.: 612,727

[22] Filed: May 21, 1984

[51] Int. Cl.[4] ..... A61H 1/00

[52] U.S. Cl. ..... 128/33; 74/61; 128/36; 128/52; 366/111

[58] Field of Search ..... 128/25 R, 25 B, 33–36, 128/31, 39, 41, 44–46, 48, 49, 51, 52, 56, 57, 67; 188/32; 74/89.17, 89.18, 40, 51, 422; 366/111; 272/73, 134, 900; 5/60–65, 108, 109, 423, 449, 463, 433, 462, 464, 469; 269/328, 325, 60, 69; 297/337, 338, 345, 346, 423, 429, 374, 375, 377, 452

[56] References Cited

U.S. PATENT DOCUMENTS

| | | | |
|---|---|---|---|
| 2,359,254 | 9/1944 | Silver | 297/452 |
| 2,687,717 | 8/1954 | Murphy | 128/33 |
| 2,840,071 | 6/1958 | McNair | 128/41 |
| 2,943,620 | 7/1960 | Sibert | 128/33 |
| 3,464,405 | 9/1969 | Kallus | 128/36 |
| 3,653,375 | 4/1972 | Raffel | 128/33 |
| 3,765,407 | 10/1973 | Prince | 128/41 |
| 3,812,848 | 5/1974 | Kollitz | 128/36 |
| 4,105,024 | 8/1978 | Raffel | 128/41 |
| 4,343,303 | 8/1982 | Williams | 128/36 |
| 4,430,992 | 2/1984 | Christ | 128/33 |

*Primary Examiner*—Clyde I. Coughenour

*Attorney, Agent, or Firm*—Polster, Polster and Lucchesi

[57] ABSTRACT

A massage device in the form of a resilient pillow having a cavity therein with at least two spaced vibrator units disposed within the cavity which when activated create a vibratory massaging effect throughout the pillow.

2 Claims, 4 Drawing Figures

MASSAGE DEVICE

BACKGROUND OF THE INVENTION

The present invention relates to massage devices and more particularly to a massage device in the form of a resilient pillow that produces a massaging effort throughout the pillow when pressure is applied thereto.

Body massage devices of various types are known in the art including pillow members that have a vibrator unit associated therewith, which, when actuated, produces a massaging effect to preselected portions of the body of a user.

The present invention provides an improved resilient massage pillow which provides a massaging effect throughout the entirety of the pillow, the intensity of which can be varied to produce either a gentle uniform massaging action or, with an easy-to-make adjustment, a more vigorous massaging action. The present invention provides such a massage pillow which responds to mere body pressure for actuation to produce a thorough, uniform massaging effect throughout the entire pillow, which can be varied in intensity in accordance with body location and body needs. For example, the pillow of the present invention can be readily applied to the neck, feet or back or any other body part for comfortable and soothing relief. In addition, the present invention provides a massage device which is economical and straightforward in manufacture and assembly, which utilizes a minimum of parts and labor and which, at the same time can avoid the use of external buttons and cords.

Various other features of the present invention will become obvious to one skilled in the art upon reading the disclosure set forth herein.

One of the objects of this invention is to provide a massaging pillow that is an improvement over those known heretofore, but is nevertheless simple and economical in construction.

Other objects will become apparent to those skilled in the art in the light of the following description and accompanying drawing.

SUMMARY OF THE INVENTION

More particularly the present invention provides a massage pillow comprising: a resilient pillow member having a cavity disposed therein; at least two vibrators disposed within the cavity in spaced relation from each other to create uniform vibrations substantially throughout the entire pillow when the vibrators are actuated; power means connected to the vibrators; and switch means to control the power means to activate and deactivate the same.

It is to be understood that various changes can be made by one skilled in the art in the arrangement, form and construction of the pillow assembly disclosed herein without departing from the scope or the spirit of the present invention.

BRIEF DESCRIPTION OF THE DRAWINGS

Referring to the drawings which disclose an advantageous embodiment of the massage pillow of the present invention.

DESCRIPTION OF THE PREFERRED EMBODIMENT

Figure 3:
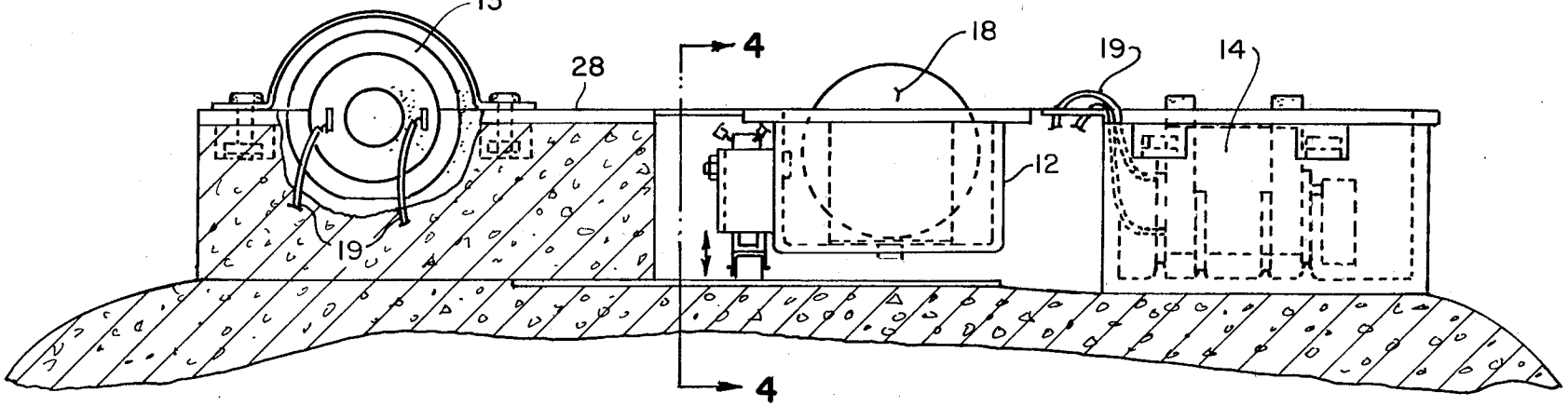
FIG. 3 is an end view of that part of the pillow assembly disclosed in FIG. 2; and, FIG. 4 is a side view taken in a plane through line 4—4 of FIG. 3.
Figure 1:
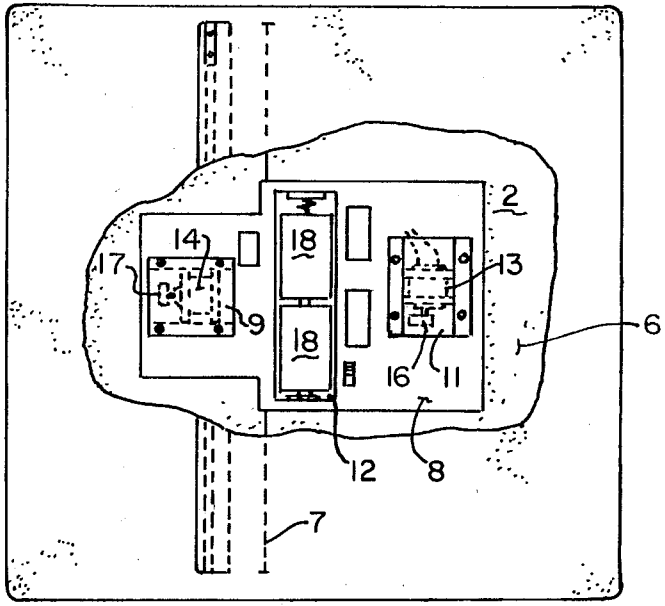
FIG. 1 is a partially broken away plan view of a portion of one illustrative embodiment of massage pillow assembly of this invention, the flywheels of the two spaced vibrators being disclosed in asynchronous relation.
Figure 4:
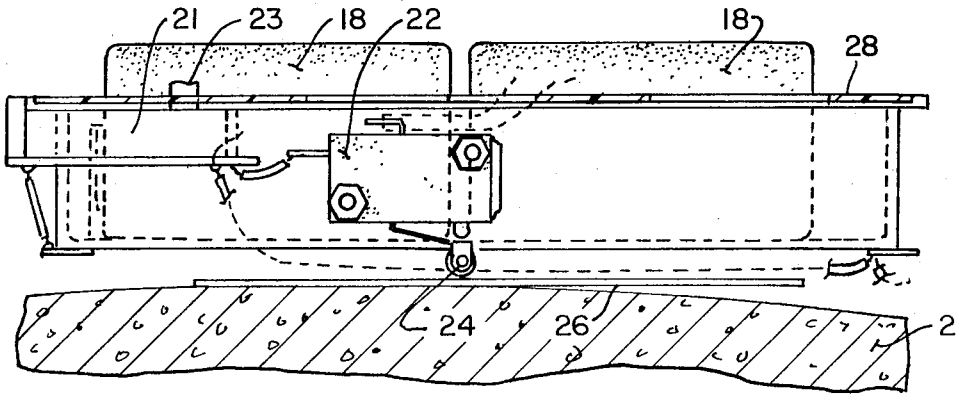
Figure 2:
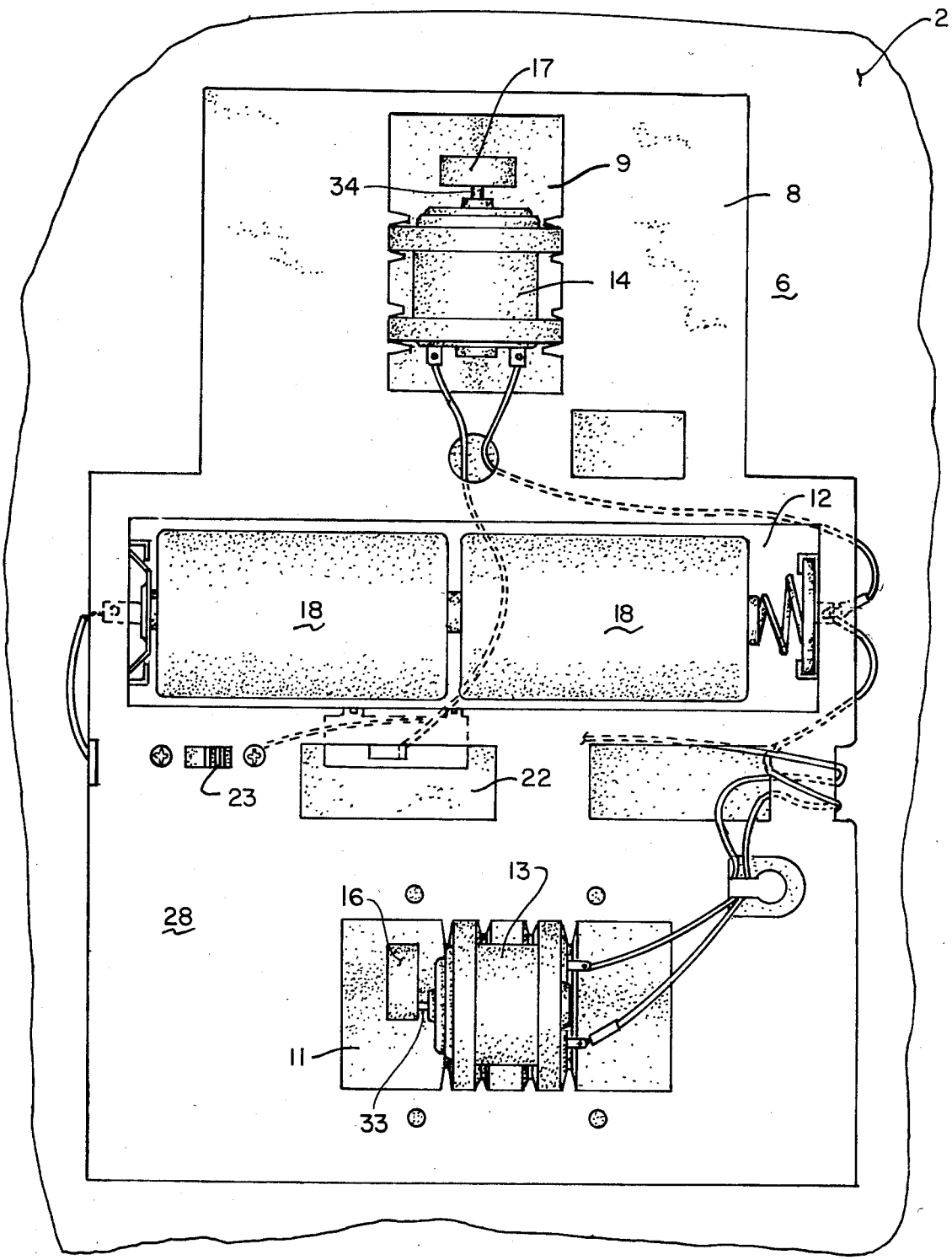
FIG. 2 is an enlarged plan view of a part of the pillow assembly of FIG. 1, disclosing further detail.

Referring to FIG. 1, resilient massage pillow 2 is disclosed with a removable pillow cover 3 which has a zippered opening 4 therein, disclosed in phantom lines. The pillow cover can be made from any one of a number of suitable, aesthetically pleasing cloth materials. Advantageously, the resilient massage pillow 2 can be formed from a suitable resilient polyvinyl foam material to include a cavity 6 therein, accessible through a slit 7 in one side of pillow 2. Disposed within cavity 6 and fastened to one cavity determining surface of pillow 2 is retaining frame 8. This frame 8, which can be formed from a suitable plastic material, has a planar upper surface 28 (as viewed in the drawings) and includes a pair of spaced outer recessed cradles 9, 11, and an intermediate recessed cradle 12 therebetween all recessed to different depths from the surface 28. The outer cradles serve to receive vibrator motors 13 and 14, each having a weighted flywheel 16, 17 respectively, mounted eccentrically directly on a drive shaft 33 and 34 respectively of the motors 13 and 14 to create vibratory motion. The shafts 33 and 34 are, as shown in FIGS. 2 and 3, parallel with the surface 28. Suitable annular rings of a hard resilient material such as hard rubber surround the motors 13 and 14 to support them in their cradles. It is to be noted that the axis of rotation of the drive shaft 34 for the flywheel 17 is so positioned as to be normal to the axis of rotation of the drive shaft 33 for fly wheel 16 and that axes of rotation of the drive shafts, hence the vibrators are disposed in frame 8 in different planes relative to the plane of the upper surface 28, hence to the planes which substantially determine the side faces of pillow 2. It also is to be noted that the flywheels 16 and 17 are in relatively asynchronous position. This positioning of the vibrators serves to achieve a preselected uniform vibration throughout pillow 2. However, it is to be understood that other relative positions of the two vibrators with such vibrators being in substantially synchronous relation also can be employed without departing from the scope of the present invention.

To power the vibrator motors, a pair of small storage batteries 18, such as "D" size batteries, are mounted in intermediate cradle 12. Batteries 18 are connected in series as part of an electrical circuit 19 which includes series connected adjustable variable resistor (switch) 21 and actuating switch 22 and the spaced vibrator motors 13 and 14 which are connected in parallel in electrical circuit 19. It is to be noted, that switch 21 includes a manually operable control 23 accessible through slit 7 of pillow 2 so that a change of position of control 23 changes resistances in circuit 19 and accordingly the operational intensity of vibrator motors 13 and 14. It also is to be noted that actuating switch 22 includes a switch control 24 which abuts flat actuating plate 26 fastened to the inner cavity determining face of pillow 2. Accordingly, when pillow 2 is compressed, plate 26 abuts switch control 24 to actuate spaced vibrator motors 13 and 14, creating a thorough, uniform, vibrating and massage effect throughout pillow 2. Depending upon the position of switch control 23 such massaging action can be either gentle or vigorous.

It is to be understood that various changes can be made in the arrangement, form and construction of the apparatus disclosed without departing from the scope or spirit of the present invention. For example, the relative position and power to the vibrator motors could be changed as could the type of variable resistance.

What is claimed is:

1. A massage pillow comprising a pillow member of resilient foam material, said pillow member having a cavity therein and having an access passage on one side thereof in communication with said cavity; a retaining frame disposed within said cavity, said retaining frame including a planar upper surface and a pair of spaced outer recessed cradles and an intermediate recessed cradle therebetween, said cradles being recessed to different depths with respect to said upper surface; a pair of vibrator motors mounted in said outer recesses, said motors having drive shafts lying parallel to said upper surface of said retaining frame, and weighted fly wheels eccentrically mounted directly on said drive shafts, the axis of rotation of the drive shaft of one vibrator motor being normal to the axis of rotation of the drive shaft of the other vibrator motor and disposed in different planes relative to the plane of said upper surface of said retaining frame; a battery pack disposed in said intermediate recessed cradle of said retaining frame between said vibrators; a switch disposed on said retaining frame adjacent said battery pack; a flat switch actuating plate disposed within said cavity on one side of said pillow to abut said first switch and actuate the same when said pillow is compressed, and an electrical circuit connecting said battery and switch.

2. A pillow in accordance with claim 1 in which a second switch is provided comprising a variable resistance member to adjust the speed of rotation of said motors, said electrical circuit connecting said battery and both said switches in series and said vibrator motors in parallel therewith.

* * * * *